US009623464B2

(12) United States Patent
Aigner et al.

(10) Patent No.: US 9,623,464 B2
(45) Date of Patent: Apr. 18, 2017

(54) BENDING TOOL SYSTEM

(71) Applicant: TRUMPF Maschinen Austria GmbH & Co. KG., Pasching (AT)

(72) Inventors: Wolfgang Aigner, Sattledt (AT); Stefano Speziali, Foligno (IT); Thomas Weiss, Linz (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 0 days.

(21) Appl. No.: 14/908,588

(22) PCT Filed: Jul. 29, 2014

(86) PCT No.: PCT/AT2014/050165

§ 371 (c)(1),
(2) Date: Mar. 22, 2016

(87) PCT Pub. No.: WO2015/013734

PCT Pub. Date: Feb. 5, 2015

(65) Prior Publication Data

US 2016/0214159 A1 Jul. 28, 2016

(30) Foreign Application Priority Data

Jul. 30, 2013 (AT) ..... A 50478/2013

(51) Int. Cl.
*B21D 5/02* (2006.01)
*B21D 5/04* (2006.01)

(52) U.S. Cl.
CPC ..... *B21D 5/02* (2013.01); *B21D 5/04* (2013.01); *B21D 5/047* (2013.01)

(58) Field of Classification Search
CPC ..... B21D 5/0236; B21D 5/02; B21D 5/04; B21D 5/047

(Continued)

(56) References Cited

U.S. PATENT DOCUMENTS 4,089,198 A * 5/1978 Amano ..... B21D 5/047 72/320
4,532,792 A * 8/1985 Hongo ..... B21D 5/04 72/319

(Continued)

FOREIGN PATENT DOCUMENTS

CN 102179431 A 9/2011
CN 202479285 U 10/2012

(Continued)

OTHER PUBLICATIONS

International Search Report of PCT/AT2014/050165, mailed Jan. 19, 2015.

(Continued)

*Primary Examiner* — David B Jones
(74) *Attorney, Agent, or Firm* — Collard & Roe, P.C.

(57) ABSTRACT

The invention relates to a bending machine (1) for bending sheet metal workpieces (2), for example a press brake or a folding machine, comprising at least one tool carrier (3), wherein a plurality of tool parts (5) that can be moved along a horizontal tool receptacle (4) are arranged on at least one tool carrier (3), at least one adjusting device (6) for moving the tool parts (5), and coupling devices (14) associated with the tool parts (5), each for connecting a respective tool part (5) to the adjusting device (6). Furthermore, according to the invention the adjusting device (6) may comprise a threaded spindle (7) extending parallel to the tool receptacle (4) and each coupling device (14) may comprise a spindle nut segment (15), wherein the spindle nut segment (15) can be coupled to the tool part (5) or to the threaded spindle (7).

10 Claims, 4 Drawing Sheets

(58) Field of Classification Search
USPC ..... 72/316
See application file for complete search history.

(56) References Cited

U.S. PATENT DOCUMENTS

| | | | | | |
|---|---|---|---|---|---|
| 4,660,402 | A * | 4/1987 | Hongo | B21D 5/02 | 72/319 |
| 4,761,985 | A * | 8/1988 | Klingesberger | B21D 5/0236 | 72/316 |

FOREIGN PATENT DOCUMENTS

| | | | |
|---|---|---|---|
| DE | 196 13 962 | A1 | 10/1997 |
| DE | 10 2007 008 312 | A1 | 8/2008 |
| EP | 0 258 204 | A2 | 3/1988 |
| EP | 0 894 550 | A2 | 2/1999 |
| JP | S61-103626 | A | 5/1986 |
| JP | 2005-144499 | A | 6/2005 |

OTHER PUBLICATIONS

Response to European Patent Office in PCT/AT2014/050165, dated Apr. 8, 2015, with English translation of relevant parts.
Response to European Patent Office in PCT/AT2014/050165, dated Aug. 31, 2015, with English translation of relevant parts.

* cited by examiner

BENDING TOOL SYSTEM

CROSS REFERENCE TO RELATED APPLICATIONS

This application is the National Stage of PCT/AT2014/050165 filed on Jul. 29, 2014, which claims priority under 35 U.S.C. §119 of Austrian Application No. A 50478/2013 filed on Jul. 30, 2013, the disclosure of which is incorporated by reference. The international application under PCT article 21(2) was not published in English.

The invention relates to a bending machine.

From EP 0 258 204 A2 a bending machine is known in which the holding down device punch of the bending bending wange is segmented. Said individual segments are mounted displaceably in a guide of the holding down device parallel to the bending axis and can be displaced by means of an adjusting bar. In this way the displaceable segments each have a coupling for connecting the individual segments optionally to the recess associated with the segment on the adjusting bar or the holding down device. The connection between the displaceable segment and adjusting bar is formed by a wedge, which can be inserted into a recess on the adjusting bar and thus forms a form-fit between the displaceable segment and adjusting bar. A recess on the adjusting bar can be assigned to a displaceable segment, whereby the wedge can only be inserted to produce the connection between the displaceable segment and adjusting bar if the latter are placed exactly above one another. By means of said segmented holding down device it is possible to process sheet metal workpieces on which lateral tabs have already been bent and which therefore have a U-shaped cross-sectional profile. Furthermore, by means of the special form of the holding down devices which are tapered also sheet metal workpieces can be processed which on the laterally bent up tab have an inwardly pointing tab and therefore a C-shaped cross-sectional profile.

The embodiment described in EP 0 258 204 A2 has the disadvantage that the recesses in the adjusting bar are configured so that the latter have to be assigned precisely to a holding down segment. In this way the adjusting bar has to be positioned exactly over said holding down device segment in order to move the coupling of the segment into engagement with the adjusting bar. As all of the recesses in the adjusting bar are attached at a fixed distance from one another the individual segments cannot be adjusted as desired and independently of one another, whereby a considerable amount of time may be needed to adjust the holding down device. Furthermore, the control is subject to high demands as the coupling in form of the wedge has to move said holding down device in engagement with the adjusting bar exactly at the right time, namely when the recess of the adjusting bar is located above a holding down device.

From JP S61 103626 a bending machine is known in which clamping jaws are arranged displaceably on a support in horizontal direction. Furthermore, an adjusting spindle is formed, on which two coupling devices are arranged, wherein the coupling devices can be moved optionally into engagement with one of the clamping jaws and the clamping jaws can thus be displaced individually. In particular, the first coupling device for displacing the clamping jaws is formed on the left side of the central plane and the second coupling device is designed for displacing the clamping jaws to the right of the central plane.

The underlying objective of the present invention is to make it possible by segmenting the holding down device or the bending tool of a bending machine to process already prebent sheet metal workpieces with laterally bent up tabs. In this case the latter individual segments should be able to be displaced rapidly and independently of one another in a horizontal direction in order to keep machine downtime as low as possible and thus increase the efficiency of the machine.

Said objective is achieved by the measures according to the invention. In particular, by means of a plurality of tool parts which are displaceable in a tool receptacle and each have a coupling device. The coupling device comprises a spindle nut section, which can be coupled to a threaded spindle, whereby a horizontal movement can be introduced to the tool bars.

According to the invention a bending machine for bending sheet metal workpieces is provided, for example a bending press or pivot bending machine, comprising at least one tool carrier, wherein on at least one tool carrier a plurality of tool parts displaceable along a horizontal tool receptacle are arranged. Furthermore, at least one adjusting device can be provided for displacing the tool part, and coupling devices assigned to the tool part for connecting a tool part to the adjusting device respectively. The adjusting device can comprise a threaded spindle running parallel to the tool receptacle and each coupling device can comprise a spindle nut section, wherein the spindle nut section can be coupled to the tool part or to the threaded spindle.

An advantage of the design according to the invention is that each tool part comprises a coupling device. Thus each tool part can be moved into engagement with the rotating threaded spindle independently of the other tool parts and at any time with the rotating threaded spindle, whereby a rapid adjustment is possible of distances between the individual tool parts. By means of a suitably designed machine control it is possible that a plurality of tool parts can be moved simultaneously into contact with the threaded spindle in order to displace the latter at the same time. It is also possible that the tool parts can be separated in an adjusting process one after the other from engagement with the threaded spindle in order in this way to form distances between the individual tool parts. In a further adjusting process it is possible to move all of the tool parts into engagement at the same time with the threaded spindle, in order to adjust the latter jointly and maintain the distance between the individual tool parts. Furthermore, it is of course also possible to move the individual tool parts into engagement one after the other, in order to thus minimise the distance between the individual tool parts again. Of course, a variation of these different options is also possible and for example half of the tool parts can be adjusted independently of the second half of the tool parts. A so-called tool part can be designed on the one hand as a bending tool, for example bending punch or bending die. However, it can also be designed as a holding down device punch or as a counter piece to a holding down device punch, for example for a pivot bending press. A further option is that the tool part is only designed as a mount in which the additional tools can be used by means of a mechanical connection.

Furthermore, it is possible that the coupling device comprises an actuating device causing the engagement of the spindle nut sections in the threaded spindle or the tool part, which is connected to the control of the bending machine. It is particularly advantageous if the actuating device is connected to the control of the bending machine, as in this way the machine can be automated. The actuating device itself can be designed in many different variants. The actuating device can for example be an electromagnetically switchable device. Furthermore, it is possible that the actuating device is a hydraulically or pneumatically activated cylinder or that a small servomotor is used as an actuating device.

Furthermore, it is advantageous if the spindle nut section is mounted rotatably in the tool part and is in continual engagement with the threaded spindle and if the actuating device is a coupled for transmitting torque between the spindle nut section and tool part. It is an advantage here that the actuating device, when it is designed as a friction coupling, can be activated or deactivated at any time. Thus, in order to move the threaded spindle via the spindle nut section, which can be designed as a full spindle nut, in drive connection with the tool element, no previous synchronisation of the threaded spindle and the spindle nut section has to be performed. The spindle nut section is supported by a roller bearing, for example a ball bearing, by means of which the spindle nut section is connected rotatably to the tool element. As the speed of the threaded spindle tends to be low and also the forces to be transmitted between the spindle nut section and tool element are low the stability requirements of said roller bearings are also negligible, so that an inexpensive bearing can be used. It is thus possible that because of the low demands made on the bearing a sliding bearing can be used which is cheaper to acquire than a roller bearing. The threaded spindle can be designed in this embodiment variant for example as a threaded spindle with a trapezoidal thread, which is simple to produce. To increase the precision of the positioning it is also possible to use a threaded spindle with a ball screw thread which is slightly more expensive to acquire.

Furthermore, it is possible that the spindle nut section is mounted in a position of rest and so as to be displaceable relative to the threaded spindle in radial direction in the tool part and can be moved into engagement with the threaded spindle by the actuating device. It is an advantage in this case that the spindle nut section is not in continual engagement with the threaded spindle, whereby the spindle nut section also does not need to be supported. In contrast to a variant with a rotating spindle nut section, in the embodiment described here a circulating ball spindle cannot be used but an adjusting thread is used, for example an trapezoidal thread. It is an advantage with the use of a trapezoidal thread that the latter is easy to manufacture. The actuating device needs to be set for such a coupling between the threaded spindle and spindle nut section so that the force with which the spindle nut section is brought into engagement is limited, as it is possible that the switching command is given to the control at a moment in which the thread tips of the spindle nut section and threaded spindle are above one another. Therefore, it is practical if the spindle nut section can slide so far over the thread tip of the threaded spindle that the thread flanks of the spindle nut section and the threaded spindle are in engagement.

According to one development it is possible that the threaded spindle comprises at least two spindle sections driven independently of one another. It is an advantage in this case that by means of independently drivable spindle sections machine downtimes can be shortened further, whereby there may an advantage with regard to the efficiency of operating the machine. The spindle sections which can be driven independently of one another can be converted such that the threaded spindle is divided centrally in the machine for example. Now both parts of the threaded spindle can be equipped with a motor, whereby the latter can be driven independently of one another. In this way for example a spindle section can have a left rotation, whereas an additional spindle section has a right rotation or is stationary. Furthermore, it is also possible to have two different adjustment speeds by means of such an embodiment.

Furthermore, it is possible that the threaded spindle comprises two part sections, which are in particular approximately of equal length, with contrary thread directions. The advantage of this embodiment is that the tool parts can be moved symmetrically apart at the same time relative to the central plane or can be moved together, wherein only one drive is required which drives the threaded spindle.

According to one development it is possible that the tool part has a mechanical interface for receiving different tool inserts. This is particularly advantageous, as for a required tool change it is not necessary to change the whole tool part together with the coupling device, but only the part of the tool needs to be changed which has no or only a few small mechanical parts. In this way it is possible to keep the number of tool parts in a coupling device as low as possible, whereby the machine can be as inexpensive and efficient as possible in use. Furthermore, it is an advantage that a possible tool change can be performed very rapidly. The mechanical interface can be designed as a rapid release coupling.

Alternatively or additionally, it is possible that the tool part is designed as a bending tool or as a holding down device and/or as a holding down device counter piece. In such an embodiment it can be advantageous that a mechanical interface need not necessarily be provided for mounting a bending tool or holding down device on the tool part. This embodiment is particularly advantageous, if on a bending machine holding down devices and the counter pieces thereof or bending tools are used, which because of their universal applicability or because of customer requirements only have to be changed rarely, if at all. In this way the functional integrity of the machine can be ensured further, whereby the complexity of the bending machine is kept as simple as possible.

Furthermore, it can be advantageous that the position of each tool part can be detected by a measuring device. It is particularly advantageous here that by detecting the position it is possible to control the movement of the individual tool parts, as the machine control needs to have access to the current position of a tool part in order in consideration of the desired target position to specify the direction of spindle rotation and the rotational speed and the switching times of the coupling device. The measuring device can be designed in the form of an incremental scale, on which each individual tool part can determine its position by means of an optical path measurement according to a reference. In addition to this possibility of optically determining the position it is also possible to perform the path measurement, for example by means of grinding resistances.

Moreover, it is possible that the bending machine comprises an identification device, by means of which at least one tool part and/or at least one tool insert can be identified. It is an advantage in this case that by identifying a tool part or a tool insert the geometry of the tool parts or tool inserts which can be saved in the machine control can be taken into account in the calculations relating to the positioning of the tool inserts or tool parts. It can be necessary in this case that each of said parts is identified individually in order to determine its geometry and in order to implement the positioning in connection with the measuring device. However, it can also be possible that from a set of identical tool inserts or tool parts, which are always used together in the bending machine, only one of said elements is identified, wherein the remaining tool parts or tool inserts do not need to be identified specifically. The identification device can be provided as an optical device which for example reads a bar code on the individual tool parts or on the individual tool inserts in that it can be moved relative to the latter. It is also possible that the identification device is performed for example by the use of RFID components.

Furthermore, it is possible that the drive device of the threaded spindle or the coupling devices have an overload protection, in particular a slip clutch. It is particularly advantageous that in the case of a fault in the control or in the case of a machine defect or operating error in which the tool parts collide with one another or with other components, the force exerted on the tool part can be limited. In this way damage to the bending machine can be prevented.

Furthermore, it can be advantageous that each tool part has a clamping device for securing in horizontal position. This is particularly advantageous, as the tool part, if it is not to be displaced, and therefore is not in engagement with the threaded spindle, should not change its position. Furthermore, such a clamping device can be used so that when a tool part is clamped an additional tool part can be displaced so far that it bears directly on the clamped tool part, without displacing the latter. In this way the tool parts are positioned to "stop" relative to one another, wherein the gap between the individual tool parts can be brought to zero, in order in this way to create a continuous tool unit. Such a clamping device can be provided in the form of a clamping wedge or pin which produces a frictional connection between the tool part and tool receptacle.

Lastly, the clamping device can be activated for the horizontal position securing by the actuating device. It is an advantage here that for activating the clamping device no separate control or power supply is necessary, but the clamping device is released at the same time as soon as the spindle nut section is moved into engagement with the threaded spindle. As soon as the activating direction is returned to its position of rest and thus the spindle nut section is moved back out of its engagement position in the threaded spindle, the clamping device is re-activated in order to secure the tool part in position.

For a better understanding of the invention the latter is explained in more detail with reference to the following Figures.

In a much simplified, schematic representation:

Figure 1:
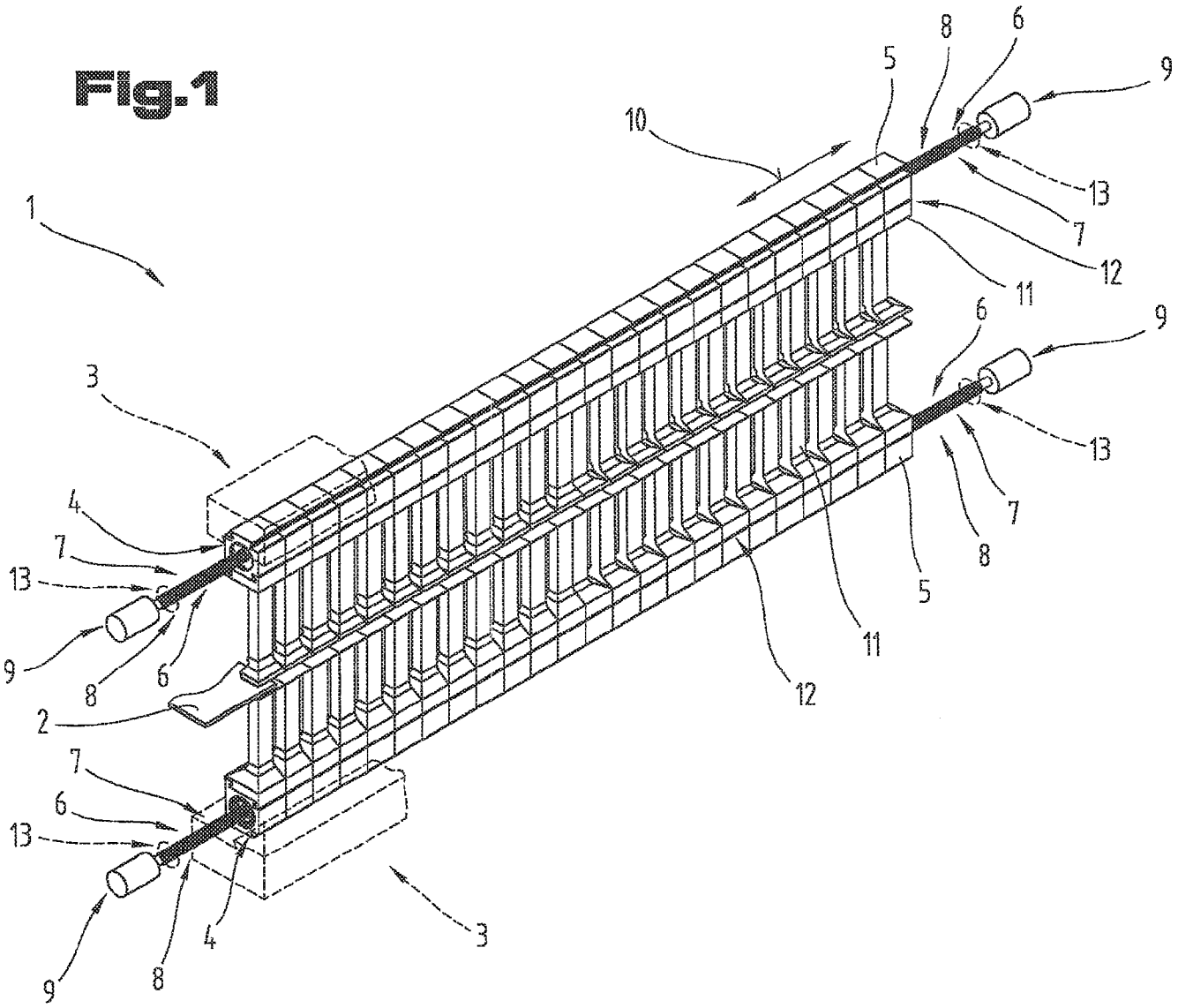
FIG. 1 shows a perspective representation of an upper and a lower tool carrier with a plurality of tool parts arranged on the tool carrier.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

FIG. 1 shows in a perspective view the essential parts of a bending machine 1 for bending sheet metal workpieces 2. In principle, the bending machine shown can be a bending press or a pivot bending machine. In this case only those parts of the bending machine are shown that are essential to the invention. A common feature of both a bending press and a pivot bending machine is that they comprise at least one tool carrier 3 into which a tool receptacle 4 is integrated. In both bending machine variants there are embodiments in which only one tool carrier 3 is provided or in which also two tool carriers 3 are provided. In one embodiment, in which a tool carrier 3 is provided, the sheet metal workpiece 2 is placed on a lower support table and then the tool carrier 3, which can be displaced vertically, is moved in the direction of the stationary support table in order to clamp the sheet metal workpiece 2 between the tool carrier 3 and the support table.

In the embodiment shown in FIG. 1 two tool carriers 3 are provided which are used for processing a sheet metal workpiece 2, wherein the upper tool carrier 3 is arranged to be vertically displaceable and the lower tool carrier 3 is arranged to be stationary.

A tool carrier 3 is always designed so that a plurality of tool parts 5 can be mounted in the tool receptacle 4 of the tool carrier 3, which tool parts are arranged horizontally displaceably in the tool carrier 3. The guiding connection between the tool receptacle 4 and tool part 5 is shown in the present drawings as a dovetail guide. A guide arrangement of this kind is only one of many possibilities of how a connection can be formed between the tool receptacle 4 and tool part 5. Of course, all other types of a tool guide known to a person skilled in the art can be used.

In order to displace the tool parts 5 in horizontal direction an adjusting device 6 is necessary which is designed in the embodiment according to the invention as a threaded spindle 7. In the arrangement shown in FIG. 1 the threaded spindles 7 are divided respectively into two spindle sections 8 which are driven respectively by a separate drive device 9. In the drawings the short part section of the threaded spindle 7 is not shown in that the latter is interrupted and thus the two spindle sections 8 which are arranged on a tool carrier 3 can be moved independently of one another. In an embodiment with a divided threaded spindle 7 it is also not necessary that the threaded spindle 7 has a bearing in the part plane, as the threaded spindle 7 is held in position by the individual tool parts 5. The drive device 9 of the threaded spindle 7 can be formed for example by an electric motor, in particular servomotor, but it is also possible that a hydraulic motor or other motors can be used as a drive device 9.

A movement can be introduced through the threaded spindle 7, which is driven by a drive device 9, in the tool part 5 in a horizontal adjusting direction 10. By means of the adjustment in horizontal direction the tool inserts 11, which are connected by a mechanical interface 12 to the tool part 5, are also moved.

As a further embodiment variant it is also possible that, not as shown FIG. 1, a tool insert 11 is mounted on the tool part 5 and can be moved by the latter, but that the tool part 5 is designed as a bending tool or holding down device element and thus no mechanical interface 12 is necessary.

Furthermore, in FIG. 1 an overload protection 13 is also indicated which can be designed for example as a slip clutch and in the case of an excessive action of force during the adjusting process on the tool part 5 the drive device 9 can separate from the threaded spindle 7.

Figure 2:
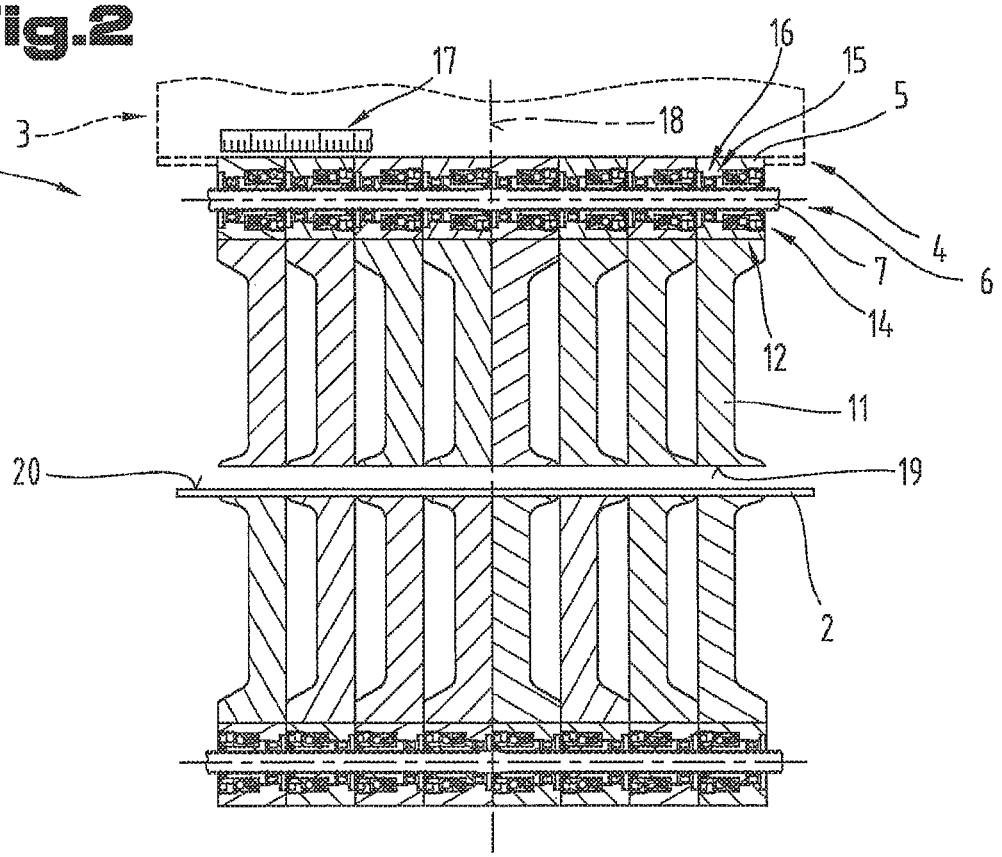
FIG. 2 is a cross-section of a tool carrier and the tool parts.

FIG. 2 shows the cross-section of a bending machine 1, wherein the cutting guide runs exactly at the level of the middle axis of the threaded spindle 7. In this Figure also the tool carrier 3 with its tool receptacle 4 and the tool parts 5 and the tool inserts 11 coupled thereon are shown in cross section.

The upper tool carrier 3 and the lower tool carrier 3 are designed to be identical in the region of the tool receptacle 4, wherein however only the upper tool carrier can be adjusted in a vertical direction. The tool parts 5 mounted in the tool carriers 3 with their attached or integrated tool inserts 11, which are mounted displaceably in the tool receptacle 4 in a horizontal adjusting direction 10, can be designed to be identical in the upper tool carrier 4 and in the lower tool carrier 3.

In the cross-sectional representation, which shows the internal features of a tool part 5, a coupling device 14 can be seen in which a spindle nut section 15 is mounted. In the shown embodiment the spindle nut section 15 is designed as a full spindle nut. Furthermore, an actuating device 16 is shown which is designed to connect the spindle nut section 15 to the tool part 5.

Furthermore, a measuring device 17 is shown schematically, which can detect the position of the individual tool parts 5 and transmit this to the machine control. By detecting the position it is possible that the machine control of the bending machine 1 can control the coupling device 14 and thus the actuating device 16 on the basis of said measurement data. By detecting the position it is also possible that no pure control command for positioning the tool parts 5 has to be used but a rule cycle can be used which determines and aligns the positions actively and individually.

Furthermore, in FIG. 2 a central plane 18 is shown, relative to which the tool inserts 11 are arranged in mirror image. This mirror arrangement and the special form of a tapering of the tool parts 5 has the advantage that not only sheet metal workpieces 2 with laterally bent tabs can be bent, which have a U-shape in cross section, but also sheet metal workpieces 2 can be bent with tabs on the laterally bent up tabs which are bent again, which thus have a C-shape cross-section. By means of the particular shaping of the tool inserts 11 it is possible that the working edge 19 of the tool insert 11 also in C-shaped sheet metal workpieces can be moved into contact in an edge area of said workpieces with the workpiece surface 20.

Figure 3:
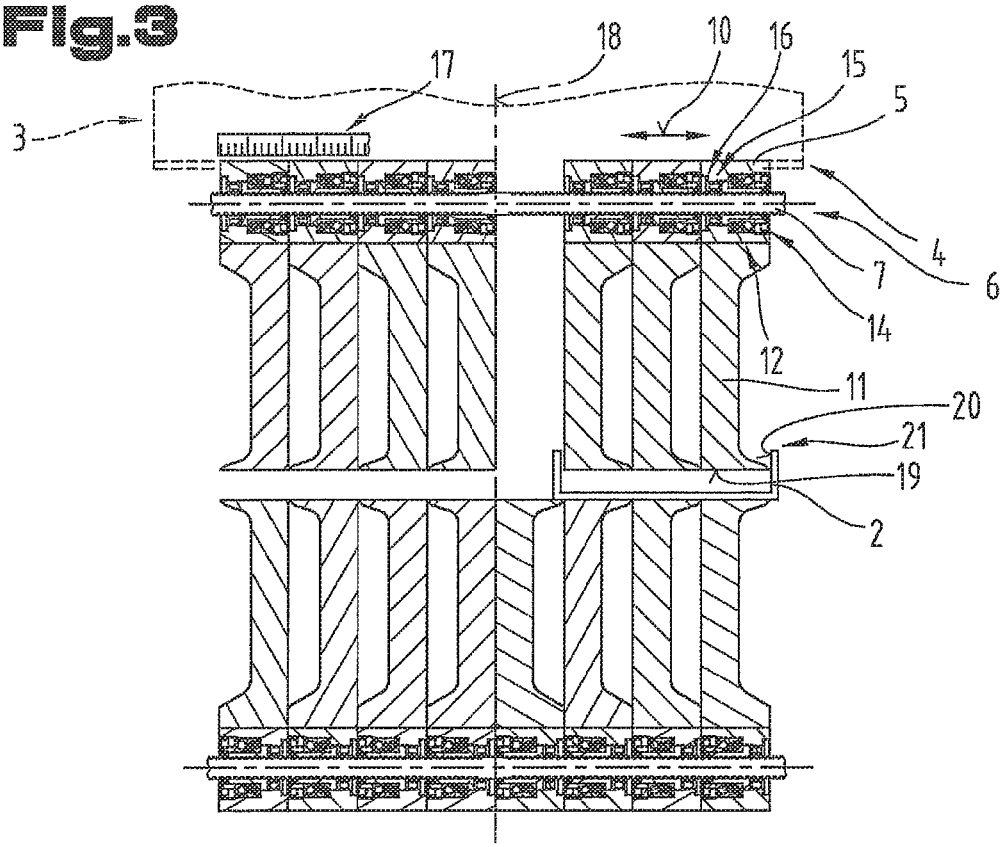
FIG. 3 is a cross-section of a tool carrier and the tool parts, wherein several tool parts are spaced apart from one another.

FIG. 3 shows a cross-section of a bending machine 1 with the same cutting guide as shown in FIG. 2. In this representation however on the upper tool carrier 3 the tool parts 5 and the attached tool inserts 11, which are located on the right side of the central plane 18 are displaced to the right from the central plane 18 in adjusting direction 10. In this way a sheet metal workpiece 2, which has laterally bent up tabs 21, can be processed in the bending machine 1, as the laterally bent tabs 21 can be inserted into the thus formed gaps between the individual tool inserts 11.

Figure 4:
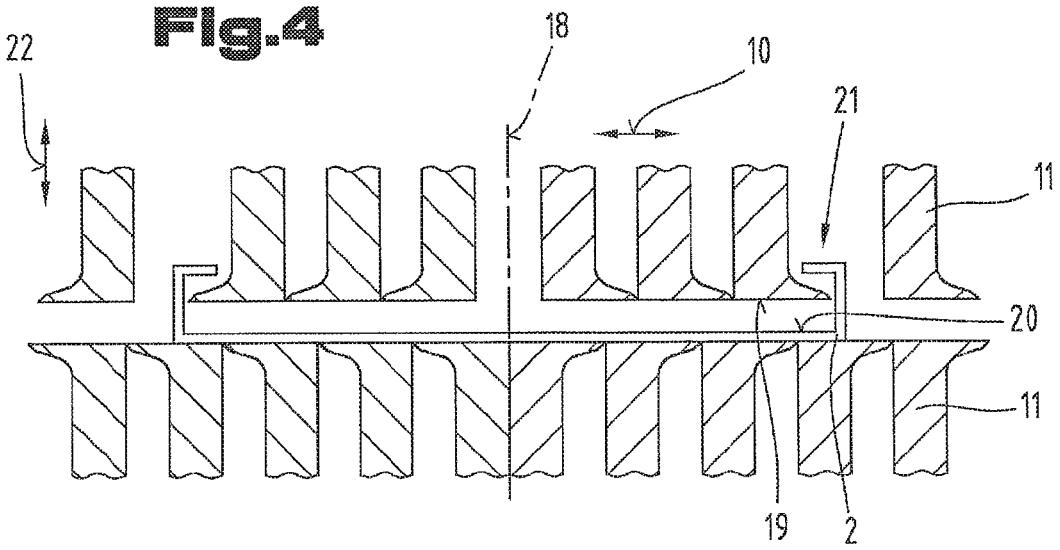
FIG. 4 is a schematic representation of tool parts, which are brought into contact with a sheet metal workpiece previously shaped into a C-profile.

FIG. 4 shows the schematic representation of a further embodiment, in which the laterally bent tabs 21 of the sheet metal workpiece 2 have an additional bend so that the cross-section of the sheet metal workpiece 2 has a C-profile. It is shown here why it is practical if the tool inserts 11 are tapered towards the top. The tool inserts 11 can be moved so far to the edge of the workpiece surface 20 that the working edge 19 can also engage in the edge area of the laterally bent tabs 21. For inserting such a sheet metal workpiece 2 the tool inserts 11 have to be pushed together in the adjusting direction 10 in the direction of the central plane 18. Now the tool carrier 3 with the tool parts 5 attached thereto and the tool inserts 11 mounted on the tool parts 5 in a vertical direction of movement 22 can be moved so far down until the working edge 19 of a tool insert 11 almost touches the workpiece surface 20. In this way the whole tool carrier 3 together with the tool parts 5 and the tool inserts 11 is pushed downwards so far until the tab 21 of the sheet metal workpiece 2 can be inserted into the tapering of the tool insert 11. Afterwards, the tool inserts 11 on both sides of the central plane 18 can be moved apart from one another in adjusting direction 10 until they almost contact the laterally bent tab 21 of the sheet metal workpiece 2. After this step the tool carrier 3 can be moved further downwards in a vertical direction of movement 22 until the working edge 19 of the tool insert 11 or the tool part 5 contacts the workpiece surface 20 of the sheet metal workpiece 2. Finally, the desired bending process can be performed. After completing the bending process a reverse sequence can be used in order to move the tool insert 11 or the tool part 5 back out of the bent sheet metal workpiece 2.

Figure 5:
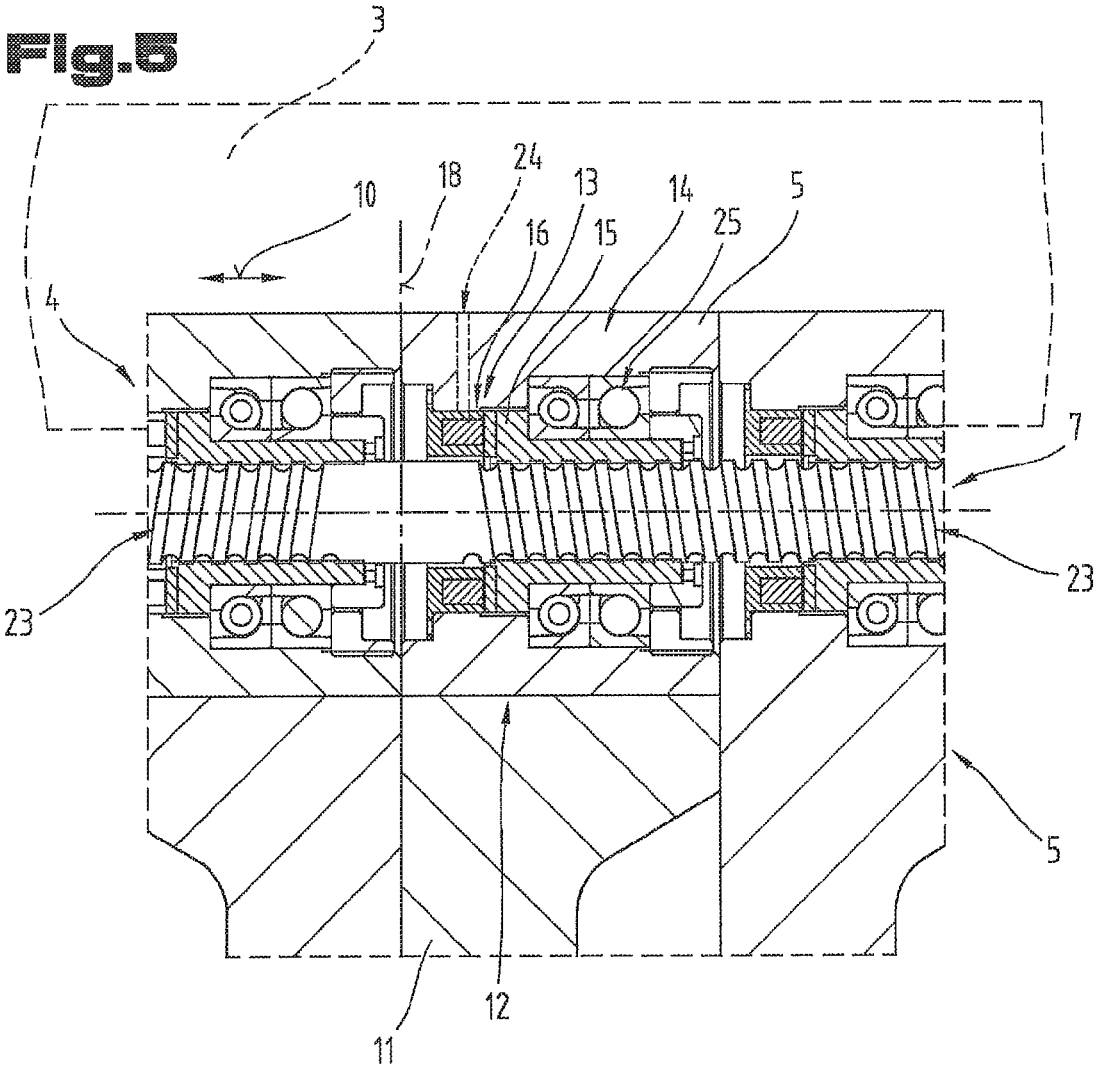
FIG. 5 is a detailed representation of a coupling device of a tool part with peripheral spindle nut section and bearing of the spindle nut section.

FIG. 5 shows a detailed view of the cross section of a tool carrier 3 and the tool receptacle 4 and the tool parts 5 with tool inserts 11 coupled thereon. In this Fig. with the tool part 5 arranged on the right a tool insert 11 is not connected by a mechanical interface 12 to the tool part 5 but the tool part 5 is shaped so that the tool insert 11 is integrated into the tool part 5. FIG. 5 also shows the central plane 18 which separates the threaded spindle 7 into two part sections 23 which have different thread alignments. In this way the tool parts 5 can be moved relative to the central plane 18 at the same time symmetrically apart from one another or towards one another, wherein only one drive device 9 is required per threaded spindle 7 which drives the threaded spindle 7. Of course, it is not absolutely necessary that the tool parts 5 which are located to the right of the central plane 18 are moved simultaneously and symmetrically with the tool parts 5, which are located to the left of the central plane 18. It is also possible that the positions of the tool parts 5 on both sides of the central plane 18 are not symmetrical.

Furthermore, in the cross-sectional representation the coupling device 14 is shown which comprises an actuating device 16. The actuating device 16 is designed in the shown view as an electromagnetically activated coupling which by means of frictional closure forms a mechanical connection between the tool part 5 and spindle nut section 15. By switching the actuating device 16 at the same time a clamping device 24 is triggered which in a position of rest of the actuating device 16 forms a connection between the tool part 5 and the tool receptacle 4 so that the tool part 5 is not displaced in adjusting direction 10 in an unwanted manner.

By means of said processes the spindle nut section 15, which is mounted by roller bearings 25 in the tool part 5, can no longer rotate with the threaded spindle 7. In this way a relative movement is achieved between the threaded spindle 7 and spindle nut section 15, in which the spindle nut section 15 stops and the threaded spindle 7 rotates. By means of the relative movement between the spindle nut section 15 and threaded spindle 7, and by the gradient of the thread of the threaded spindle 7 the tool part 5 is displaced in the tool receptacle 4 along the adjusting direction 10. Said adjusting process can be performed at the same time for a plurality of tool parts 5.

So as not to damage the bending machine during said adjusting process it is possible that the actuating device 16 is designed at the same time as a slip clutch and thus represents an overload protection 13 which protects the machine from damage.

If during said adjusting process a tool part 5 has reached its final and predefined position the actuating device 16 is deactivated, whereby the torque-closed connection between the tool part 5 and spindle nut section 15 is released. In this way the spindle nut section 15 can rotate with the threaded spindle 7 again. Furthermore, by means of this process the clamping device 24 is used again so that the tool part 5 is received in a displaceably secure manner in the tool receptacle 4 of the tool carrier 3.

Figure 6:
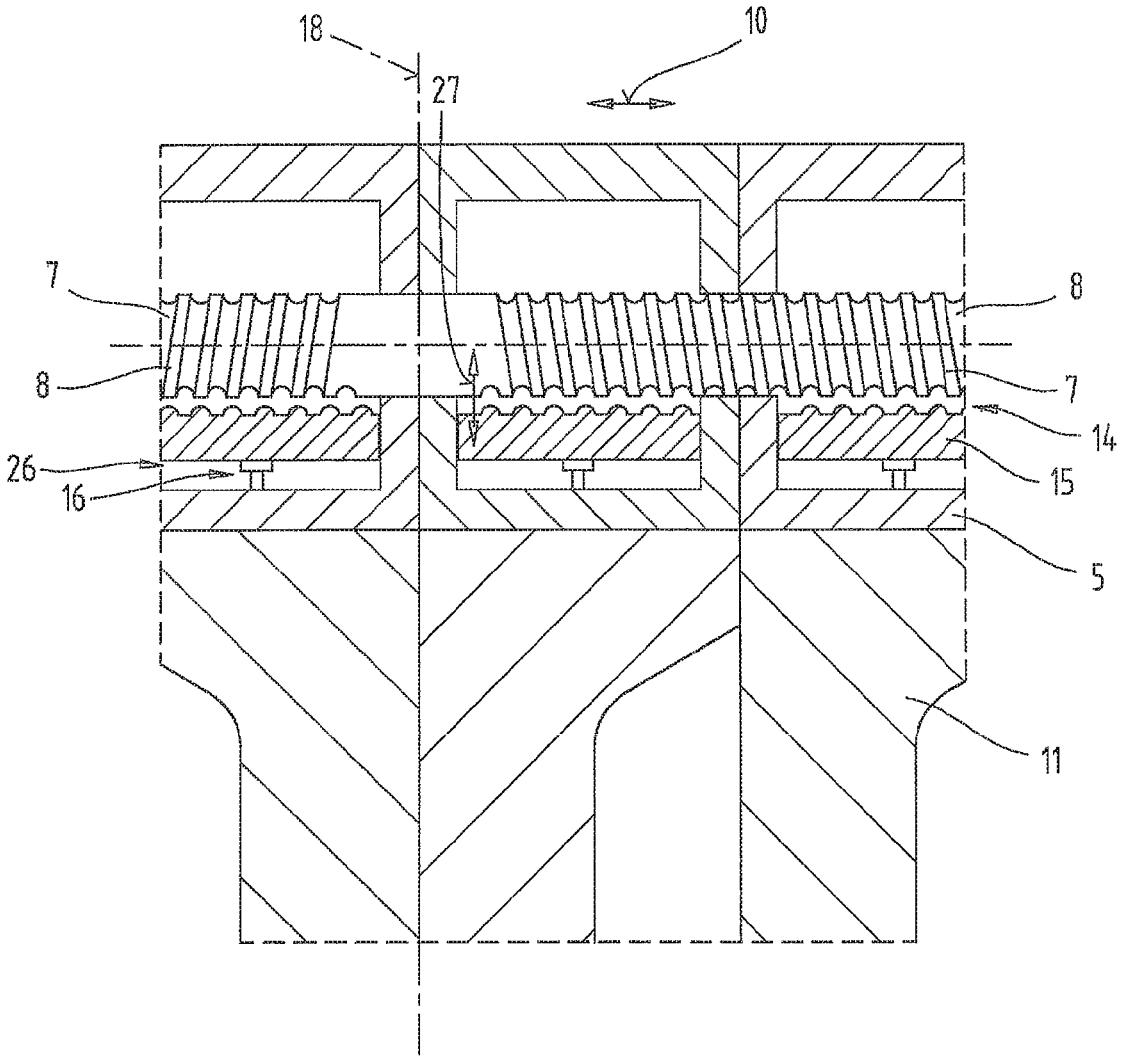
FIG. 6 is a detailed representation of a coupling device of a tool part with lower spindle nut section and mount of the spindle nut section.

FIG. 6 shows a further and if necessary independent embodiment of the tool part 5, wherein again for the same parts the same reference numerals or component names have been used as in the preceding FIG. 1-5. To avoid unnecessary repetition reference is made to the detailed description in the preceding FIG. 1-5.

FIG. 6 shows the cross section of a bending machine 1, wherein the cutting guide runs exactly at the level of the central axis of the threaded spindle 7. This Figure shows a further embodiment variant of a tool part 5, in which the spindle nut section 15 is not designed as a rotating spindle nut but in which the spindle nut section 15 is integrated into a recess 26 of the tool part 5. In this case the actuating device 16 is designed as a hydraulically or also pneumatically activated cylinder. Of course, other drives can also be used as actuating devices 16. The actuating device 16 moves the spindle nut section 15 upwards so far in activating direction 27 until the latter is in engagement with the threaded spindle 7. As soon as the spindle nut section 15 has been moved into engagement with the threaded spindle 7, the rotational movement of the threaded spindle 7, determined by the thread gradient and the relative movement to the spindle nut section 15 into a translatory movement, in which the tool part 5 is displaced in adjusting direction 10 along the tool receptacle 4.

If the intended position of the tool part 5 is reached during the adjustment process, the actuating device 16 is moved back from its activating position into its position of rest, whereby the spindle nut section 15 is moved back out of the engagement position of the threaded spindle 7. Also in this embodiment a clamping device 24, not shown here, can be provided which clamps the tool part 5 relative to the tool receptacle 4.

The embodiment variant shown in FIG. 6 shows a threaded spindle 7, which is divided in the central plane 18 into two spindle sections 8. Said spindle sections can be driven independently of one another by a drive device 9, whereby the adjustment of the tool parts 5 to the right of the central plane 18 can be performed independently and also in the same or opposite adjusting direction 10 as the adjustment of the tool parts 5 which are located on the left side of the central plane 18.

In the embodiment variants shown in FIG. 1-6 the tool parts 5, or the tool inserts 11 are presented as a holding down punch, or as a counter punch for a pivot bending machine. For the use of such a structure in a bending press only the upper tool parts 5, or tool inserts 11, have to be designed as a bending punch and the lower tool parts 5, or tool inserts 11 as a die.

The example embodiments show possible embodiment variants of the tool carrier 3 together with the components arranged thereon, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field.

Furthermore, individual features or combinations of features from the shown and described different example embodiments can represent in themselves independent solutions according to the invention.

The problem addressed by the independent solutions according to the invention can be taken from the description.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

Mainly the individual embodiments shown in FIGS. 1-6 can form the subject matter of independent solutions according to the invention. The objectives and solutions according to the invention relating thereto can be taken from the detailed descriptions of these figures.

Finally, as a point of formality, it should be noted that for a better understanding of the structure of the bending machine 1 the latter and its components have not been represented true to scale in part and/or have been enlarged and/or reduced in size.

LIST OF REFERENCE NUMERALS

1 bending machine
2 sheet metal workpiece
3 tool carrier
4 tool receptacle
5 tool part
6 adjusting device
7 threaded spindle
8 spindle section
9 drive device
1 adjusting direction
11 tool insert
12 mechanical interface
13 overload protection
14 coupling device
15 spindle nut section
16 actuating device
17 measuring device
18 central plane
19 working edge
20 workpiece surface
21 tab
22 vertical direction of movement
23 part section
24 clamping device
25 roller bearing
26 recess
27 activating direction

The invention claimed is:

1. A bending machine for bending a sheet metal workpiece comprising:

(a) a bending machine control;

(b) at least one tool carrier comprising a horizontal tool receptacle and a plurality of coupling devices;

(c) a plurality of tool parts arranged on the at least one tool carrier and displaceable along the horizontal tool receptacle;

(d) at least one adjusting device for displacing the tool parts comprising a threaded spindle running parallel to the horizontal tool receptacle;

wherein each coupling device separately connects a respective tool part individually to the at least one adjusting device and comprises a spindle nut section and an actuating device;

wherein the spindle nut section couples to at least one of the respective tool part and the threaded spindle;

wherein the actuating device is connected to the bending machine control and causes the spindle nut section to engage in the threaded spindle or the respective tool part;

wherein the spindle nut section is mounted rotatably in the respective tool part and is in continual engagement with the threaded spindle; and wherein the actuating device is a coupling for transmitting torque between the spindle nut section and the respective tool part.

2. The bending machine as claimed in claim 1, wherein the threaded spindle comprises at least two individually-driven spindle sections.

3. The bending machine as claimed in claim 1, wherein the threaded spindle comprises two part sections of approximately equal length with contrary thread directions.

4. The bending machine as claimed in claim 1, wherein each tool part comprises a mechanical interface for receiving different tool inserts.

5. The bending machine as claimed in claim 1, wherein each tool part is selected from the group consisting of a bending tool, a holding down device, and a holding down device counter piece.

6. The bending machine as claimed in claim 1, further comprising a measuring device for determining a position of each tool part.

7. The bending machine as claimed in claim 1, further comprising an identifying device for identifying at least one tool part, at least one tool insert, or at least one tool part and at least one tool insert.

8. The bending machine as claimed in claim 1, further comprising a drive device driving at least one of the threaded spindle and the coupling devices, wherein the drive device comprises an overload protection.

9. The bending machine as claimed in claim 1, wherein each tool part has a clamping device for securing the tool part in a horizontal position.

10. The bending machine as claimed in claim 9, wherein each clamping device is activated by the activating device for securing the horizontal position.

* * * * *